US006351901B1

(12) United States Patent
Amsel

(10) Patent No.: US 6,351,901 B1
(45) Date of Patent: Mar. 5, 2002

(54) STEAM IRON WITH CAPILLARY DEVICE

(75) Inventor: Klaus Amsel, Schmitten (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/744,630

(22) PCT Filed: Aug. 2, 1999

(86) PCT No.: PCT/EP99/05556

§ 371 Date: Mar. 9, 2001

§ 102(e) Date: Mar. 9, 2001

(87) PCT Pub. No.: WO00/08247

PCT Pub. Date: Feb. 17, 2000

(30) Foreign Application Priority Data

Jul. 31, 1998 (DE) ..... 198 34 605

(51) Int. Cl.[7] ..... D06F 75/22
(52) U.S. Cl. ..... 38/77.8
(58) Field of Search ..... 38/77.1, 77.5, 38/77.83, 75, 77.8; 222/630, 631

(56) References Cited

U.S. PATENT DOCUMENTS

| | | | | |
|---|---|---|---|---|
| 2,550,825 A | * | 5/1951 | Kolodie | 38/77.8 |
| 3,670,433 A | | 6/1972 | Hardwick et al. | |
| 4,459,771 A | | 7/1984 | Ogata | |
| 4,656,763 A | * | 4/1987 | Kawasaki et al. | 38/77.83 |
| 5,507,108 A | * | 4/1996 | Bruggink et al. | 38/77.8 |

FOREIGN PATENT DOCUMENTS

| | | | | |
|---|---|---|---|---|
| DE | 26 05 027 A1 | | 8/1977 | |
| DE | 7805719 | | 9/1978 | |
| DE | 3708774 A1 | | 9/1988 | |
| DE | 296 01 669 U1 | | 8/1997 | |
| DE | 694 01 725 T2 | | 8/1997 | |
| EP | 0 629 736 A1 | | 12/1994 | |
| FR | 689084 | | 3/1940 | |
| FR | 690482 | | 4/1940 | |
| JP | 4073099 | * | 5/1992 | 38/77.8 |
| RU | 1618799 | * | 1/1991 | 38/77.83 |
| WO | WO 98/09015 | | 3/1998 | |

* cited by examiner

*Primary Examiner*—Ismael Izaguirre
(74) *Attorney, Agent, or Firm*—Fish & Richardson, P.C.

(57) ABSTRACT

The invention is directed to a steam iron with a steam generating device for the generation of steam and with an application device for releasing additives to the steam. According to the invention, the application device includes a capillary device for release of the additive to the steam.

29 Claims, 11 Drawing Sheets

STEAM IRON WITH CAPILLARY DEVICE

This invention relates to a steam iron with a steam generating device for the generation of steam and with an application device for releasing additives to the steam, and a valve device therefor.

In connection with steam irons a variety of additives are in use which are applied to the objects needing to be treated with steam. During ironing, ironing auxiliaries, starch, sliding agents, softeners, fragrances, cleaning agents, products for fabric care, perfumes, impregnating agents, etc. are applied to the laundry to be ironed (cf., for example, WO 91/19037 or WO 95/06154). For this purpose, it is conventional practice to feed the additive into the water reservoir or the water supply of the steam iron, so that the additive is evaporated together with the water and, combining with the steam, is applied to the laundry (cf. U.S. Pat. Nos. 5,138,778, 5,526,595, EP 06 29 736 A1, GB 23 04 740 A). This approach has, however, the disadvantage that residues of the additives deposit in the fluid circuit and the steam generating device, in particular in the steam generating chamber, and in cases where, for example, steam irons equipped with a steam burst function are involved, may be discharged from the steam vents on the iron's underside similar to scale deposits.

From DE 296 01 699 U1 a steam iron is known in which fragrances are not admixed until after the steam has already formed. To this effect, the fragrances are pressurized, sprayed into the steam through a nozzle and admixed thereto. This solution necessitates, however, an elaborate pressure application to the fragrances. In addition, the spray discharge orifice may become clogged with scale as a result of the passing steam.

By contrast, it is an object of the present invention to provide an improved steam iron which avoids the disadvantages of known solutions. In particular the invention aims to achieve a reliable and trouble-free introduction of the additives while providing a straightforward construction of the steam iron. It is a further object to provide a valve device therefor.

This object is accomplished by the invention in a steam iron of the type initially referred to in that the application device includes a capillary device for release of the additive to the steam. Accordingly, the application device is of the self-feeding type, possessing elements for supplying the additive to the steam without requiring external energy. There is no need to pressurize the additive. With the capillary device the application device has self-adjusting metering elements available which release precisely the desired amount of the additive to the steam. Advantageously, the application device operates without a nozzle for vaporizing the additive, thereby avoiding the buildup of scale.

In a further aspect of the present invention, the additive is released at a location downstream from the steam generating device, in particular in a steam distribution chamber, and admixed to the steam. This has the advantage of preventing residues from depositing and accumulating on the steam generating device. At least, however, the additive is released in an area in which it can mix with the steam, rather than with the liquid water. Preferably, this area is not identical with the area where the water is drip-fed into the steam generating chamber, but is at a location adjacent thereto where the steam passes by on its way to the steam exit.

Preferably, the capillary device is displaceably mounted in such fashion as to be movable into and removable from a steam flow path. In particular when the capillary device is not required to release additives to the steam, it may be removed from the steam flow path.

It will be appreciated that a variety of constructions are possible for the capillary device. Preferably, the capillary device includes a capillary wick. The capillary wick is advantageously dimensionally stable, resisting in particular pressure and buckling. For the capillary device provision may be made for a seal through which the capillary wick is slidable to enter the flow path of the steam. With the capillary device in the retracted position, the seal closes the steam flow path.

For sufficient rigidity, in a preferred embodiment of the present invention the capillary device includes a capillary fabric and a support carrying the capillary fabric. This enables a braiding or fabric or cloth to be used which is optimal for the capillary effect, irrespective of the mechanical properties. The support lends the required stiffness and strength. The supply of the additive takes place in the capillary fabric. With regard to the shape design, a wide variety of possibilities are available. Preferably, provision is made for a braided hose into which the support is inserted. Owing to the inner lying arrangement of the support, the additives are released to the passing steam effectively.

Conveniently, the capillary device is temperature-resistant to resist the effect of heat of the steam. In particular provision may be made for a braiding of glass filaments, with the diameter of the individual filaments of the braiding preferably amounting to between 5 and 50 $\mu$m, approximately.

It will be appreciated that the capillary device may communicate directly with a reservoir storing the additive. Preferably, however, the connection between the additive storage reservoir and the capillary device is controlled by an interposed valve device. When no additives are to be released, the valve is operable to disconnect the capillary device from the additive storage reservoir. To release additives, the valve opens the connection between the additive storage reservoir and the capillary device. This has the advantage of preventing the additives from volatilizing through the capillary device when the steam iron is out of operation or when an operating mode without the release of additives is selected. With the valve device the application device may be turned on and off.

The valve device may be of a multi-piece construction. For example, a rubber-elastic shutoff element may be plug-connected with a central valve passage body. Preferably, however, the valve device is constructed as a single-piece component. Preferably, the valve device may be formed of a soft plastic material, in particular the valve device is a single-piece rubber part, that is, it is made of a rubber-elastic material. This affords simplicity of construction and an uncomplicated assembly.

According to an advantageous embodiment of the invention, a shutoff element for shutting off the valve passage extends in the shape of a collar or cup rim from a central valve passage body comprising at least one valve passage, said shutoff element being adapted to be turned up from a position as manufactured into an operating position. In the non-turned-up position in which the valve is manufacturable, the shutoff element extends from one side of the central valve passage body into a direction away from the valve passage body, so that the shutoff element forms a type of pedestal for the valve passage body. After the shutoff element is turned up, the central valve passage body lies with at least one section thereof, which contains the at least one valve passage, within a chamber bounded by the shutoff element as a circumferential wall in cup shape. With the shutoff element turned up, in particular a sealing surface thereof is biased toward the valve passage body. In this position the shutoff element is movable between a shutoff position in which the sealing surface of the shutoff element makes engagement with the valve passage body and a flow position in which the valve passage is in fluid communication with the additive storage reservoir. Preferably, the shutoff element is adapted to snap back and forward in bistable or monostable fashion between the closed position and the open position. The one-piece construction of the valve device notwithstanding, the turnup configuration of the shutoff element affords simplicity of manufacture substantially without cores, for example, when it is manufactured using an injection molding or casting process.

For accurate metering of the released additive, the valve device includes in a preferred embodiment of the invention a buffer reservoir which is disconnected from the additive storage reservoir with the valve device in closed condition and is connected with a discharge side. This enables a metered charge to be obtained. The buffer reservoir is filled with the shutoff element in open position. Once the shutoff element is in the closed position, only such amount of additive as is held in the buffer reservoir can be released. Preferably, the buffer reservoir is formed by a cavity defined by the valve passage body and the shutoff element.

To achieve a good sealing effect between the shutoff element and the valve passage body, a conical sealing fit is conveniently provided between these two parts. The conical sealing surfaces provide the high sealing effect in the presence of low biasing forces.

In a further aspect of the present invention, simplicity of construction of the application device may be accomplished in that the capillary device is securable directly to the valve device. To this effect the valve device may include a mount, in particular a holding fixture, into which the capillary device is insertable.

According to a preferred embodiment of the invention, the valve device has integrally formed on it a reservoir seal to effect a seal on the additive storage reservoir, in particular the shutoff element may be connectable with the additive storage reservoir in a sealing fashion.

In a particularly advantageous embodiment of the invention, the valve device is constructed as the valve head of a storage cartridge, said valve head, by pushing it into the cartridge interior, being movable into an open position. In this arrangement the valve head may be designed to protrude beyond the cartridge housing in longitudinal direction so that opening of the valve can be effected by the application of pressure against an end surface opposite the head. Preferably, the shutoff element is connected with the cartridge so that pressure exerted on the elastically biased valve passage body releases the valve passage. It will be understood, of course, that the reverse arrangement is also possible, yet the described connection of the shutoff element with the cartridge results in a particularly favorable and simple construction. Hence, as the valve head is pushed into the interior of the storage cartridge, the shutoff element is moved relative to the valve passage body, thereby releasing the valve passage disposed therein.

According to another advantageous aspect of the invention, the application device is configured as a separate, prior assembled replacement unit. Hence the application device is detachable from the balance of the steam iron's body. If desired, the steam iron may also be used without the application device. Regardless of whether or not the capillary device is present, the construction of the application device as a separable module has the advantage that during operation of the steam iron a selection can be made between the application of various additives speedily and independently of the filling level of the additive storage reservoir. In particular the operations of draining a heretofore used additive from the additive storage reservoir and refilling it with the desired additive are avoided. Furthermore, when the reservoir is depleted it is only necessary to replace the application device as a unit without the need to manipulate with the additive directly. Preferably, the steam iron includes a suitable receptacle into which the application device is insertable.

The replacement unit advantageously comprises the storage cartridge, the capillary device and the valve head which sits on the cartridge and carries the capillary device.

For simplicity of operation the application device is preferably movable into and lockable in various positions, such that the release of additive by the capillary device is activatable and deactivatable. In particular the storage cartridge may be displaceable and lockable in position, so that the valve head opens and closes and the capillary device is moved into and out of the steam path. Advantageously, provision is made for a locking mechanism fixing the application device in the desired position.

In a further aspect of the invention, ease of operation using an operator's fingers, in particular a thumb, is accomplished by providing for the application device to be insertable from above into a recess accessible from the outside and terminating in a gripping area. Accordingly, the cartridge itself is the control element of the application device.

To be able to apply the additive to the object to be treated also independently of the steam application, the application device may be brought into fluid communication with a spraying device for spraying the objects to be treated. Surfaces requiring particularly intensive treatment, for example, may thus receive an increased amount of the additive.

With regard to the valve device, the invention object is accomplished with the features of claim 24. The valve device is advantageously formed of a one-piece, rubber-type body whose elasticity and shape are utilized to provide the resilient opening and closing motion. In addition, a rim of the rubber-type valve device is secured to the fluid reservoir in such manner that a minor deformation produces a tight connection. Neither a spring nor an O-ring seal are necessary additionally.

Further features, advantages and application possibilities of the invention will become apparent from the subsequent description of embodiments illustrated in more detail in the accompanying drawings. It will be understood that any feature described and/or represented by illustration, whether used singularly or in any combination, forms the subject-matter of the present invention, irrespective of their summary in the claims and their back reference.

Figure 20:
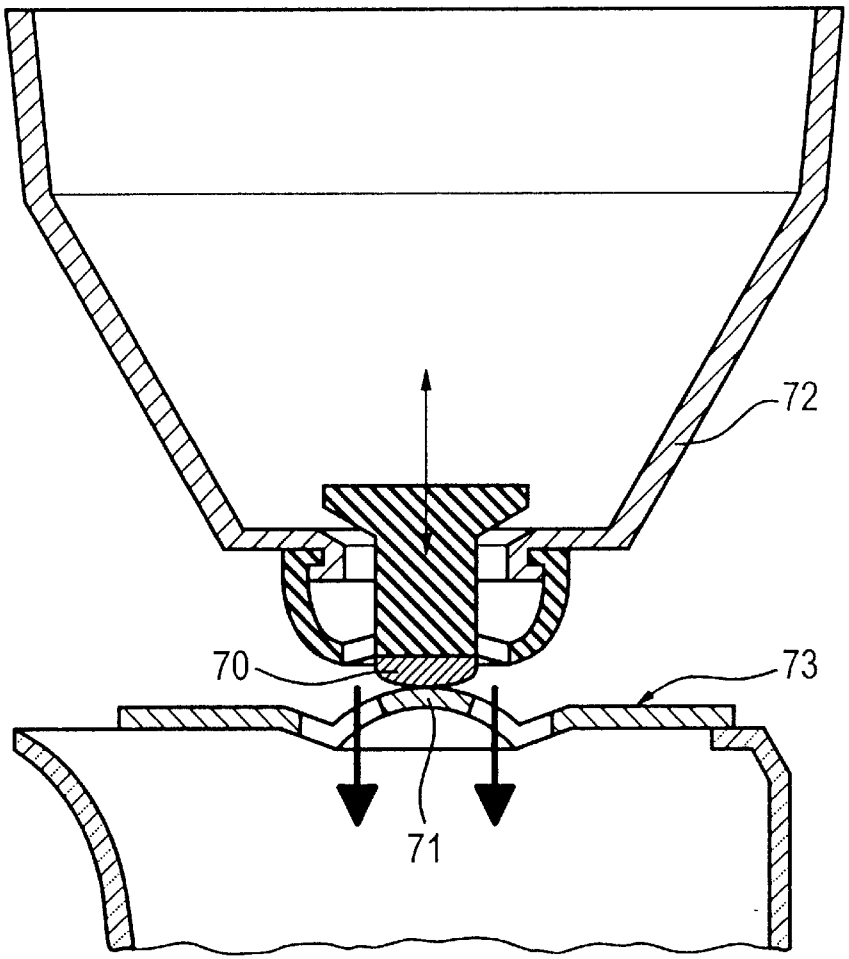
Figure 19A:
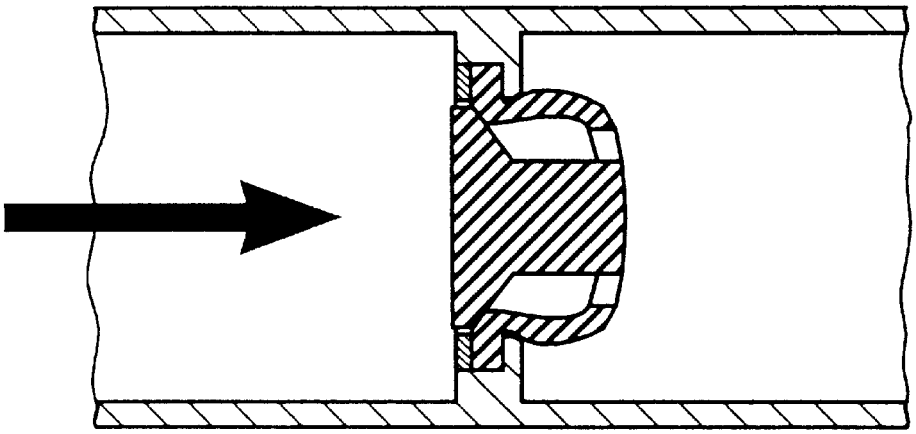
Figure 19B:
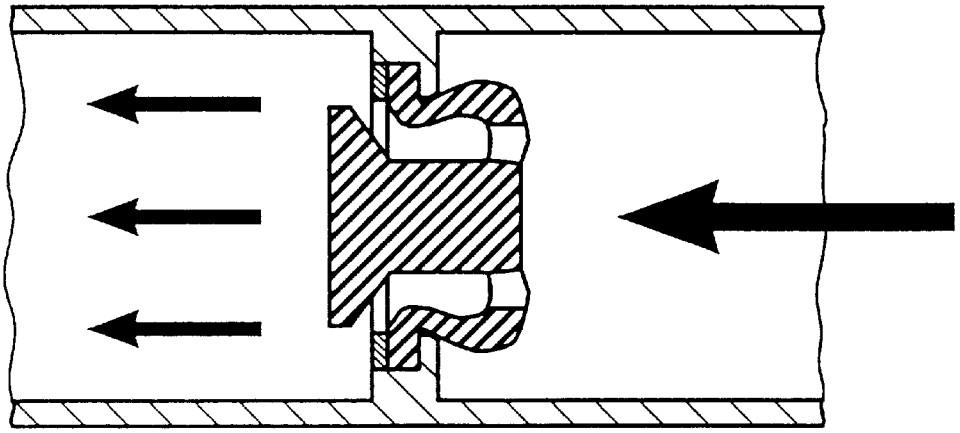
Figure 21:
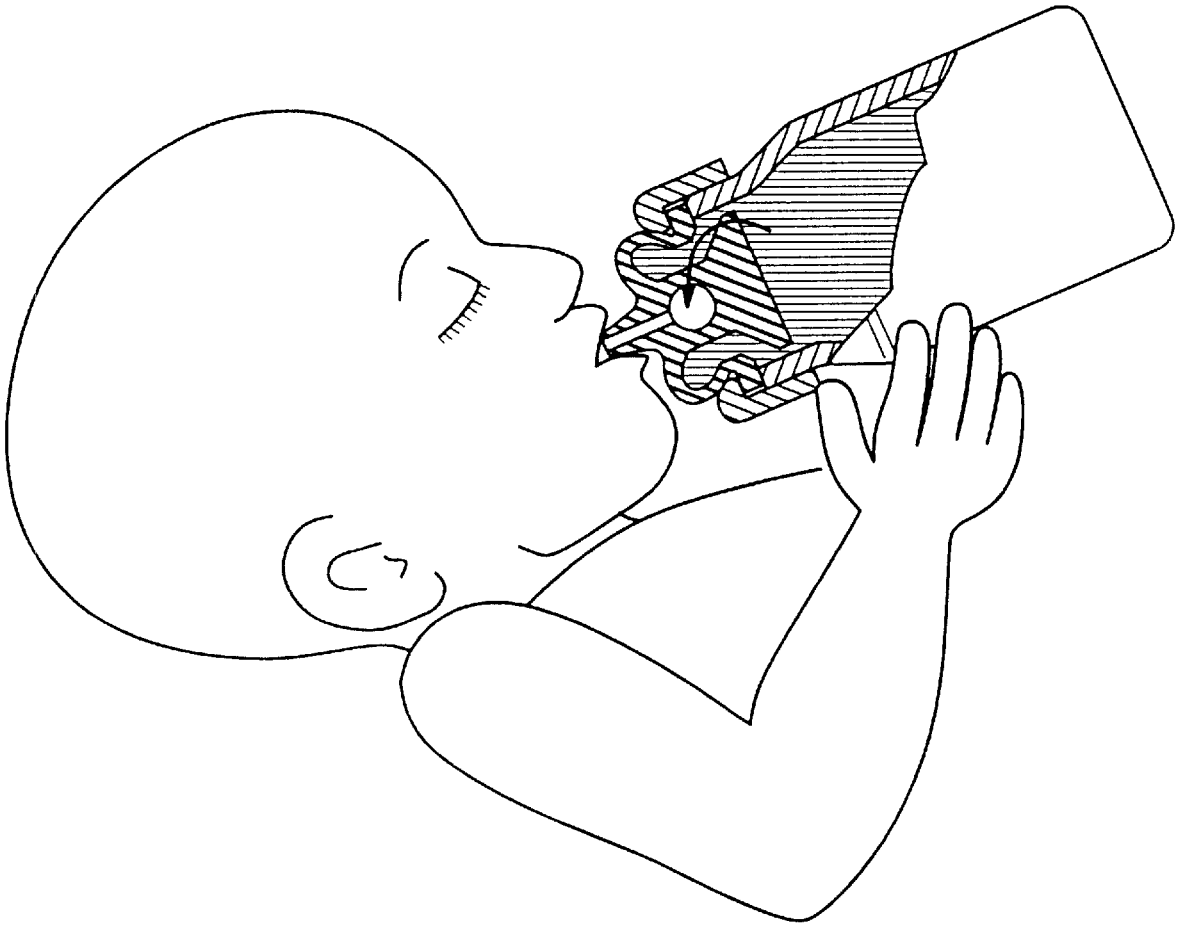

FIG. 19*a* is a sectional view of a valve device mounted in a tube as a check valve in closed condition;

FIG. 19*b* is a sectional view of a valve device similar to FIG. 19*a*, but in open condition;

FIG. 20 is a schematic sectional view of a valve device used as a drip-stop device on a coffee maker; and FIG. 21 is a schematic sectional view of a valve device secured to a nursing bottle.

Figure 1:
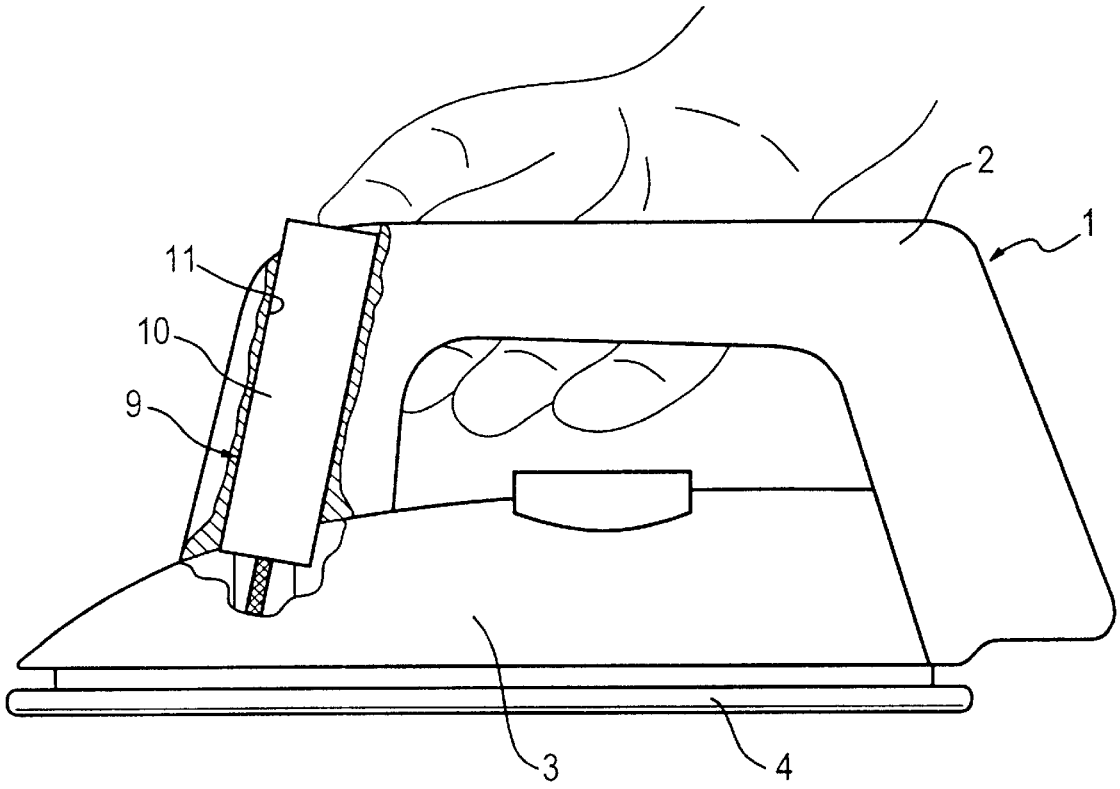
FIG. 1 is a schematic side view of a pressing iron comprising an application device according to a preferred embodiment of the invention.

The steam iron of FIG. 1 has a housing 1 with a handle-shaped gripping portion 2 spanning and connected with a tank portion 3 for storing water. Arranged on an underside of the iron's housing 1 which may be injection-molded from a plastic material is a heatable soleplate 4 which conventionally is a metal casting. The soleplate 4 lies beneath the tank portion 3 of the iron's housing 1.

Figure 2:
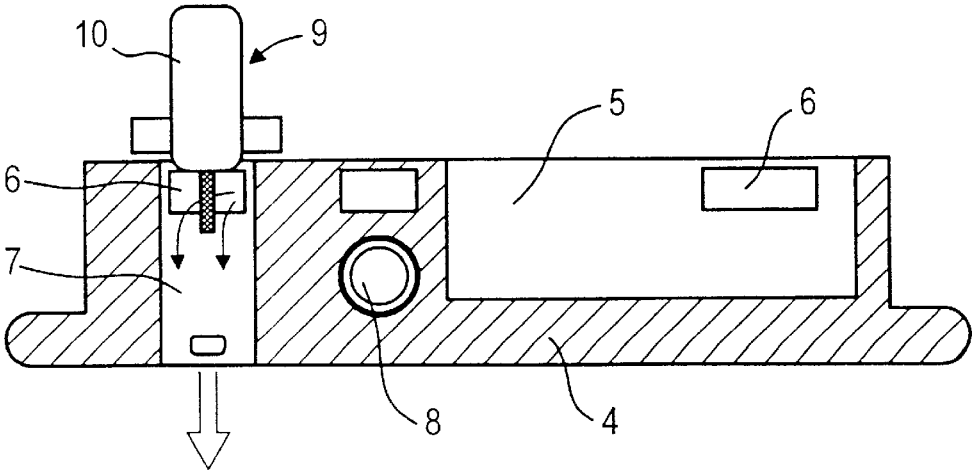
FIG. 2 is a schematic sectional view of the lower portion of the pressing iron comprising a heatable soleplate, an evaporation chamber, and the arrangement of the application device in the flow path of the generated steam.

As FIG. 2 shows, a steam generating chamber 5 forming part of a steam generating device is disposed above the soleplate 4, in which chamber the water stored in the tank portion 3 of the housing is converted into steam. To this effect, the water is drip-fed from the tank portion 3 via a drip valve into the steam generating chamber 5 in which the water is evaporated. From the steam generating chamber 5 the steam thus produced is directed via a steam flow duct 6 into a steam distribution chamber 7 from which the steam exits through outlet ports on the underside of the soleplate 4 onto the laundry to be ironed. While FIG. 2 shows only one outlet port, it is preferable to provide on the underside several outlet ports which branch off from the steam distribution chamber 7 and are in fluid communication therewith.

The soleplate 4 and the steam generating chamber 5 disposed above it may be electrically heatable in conventional manner, using, for example, a heating resistor 8 indicated schematically in FIG. 2.

As FIG. 1 shows, the steam iron includes an application device 9 which enables an additive to be released to and mixed with the steam. Preferably, a liquid, water-soluble additive is released. In particular, ironing auxiliaries, starch, sliding agents, softeners, cleaning agents, products for fabric care, perfumes and fragrances as well as impregnating agents may find application as additives to be applied to the laundry together with the steam.

To accomplish this, the application device 9 possesses a cartridge 10 for storing the additive. The iron's housing 1 has in its gripping portion 2 or at some other location a recess 11 adapted to receive the cartridge 10 (cf. FIG. 1). The cartridge 10 is insertable in such manner that the cartridge 10 has its bottom end approximately on the outside of the iron's housing 1. where it can be pushed by an operator's thumb or other finger in order to activate and deactivate the application device, as will be explained in more detail subsequently.

Figure 3:
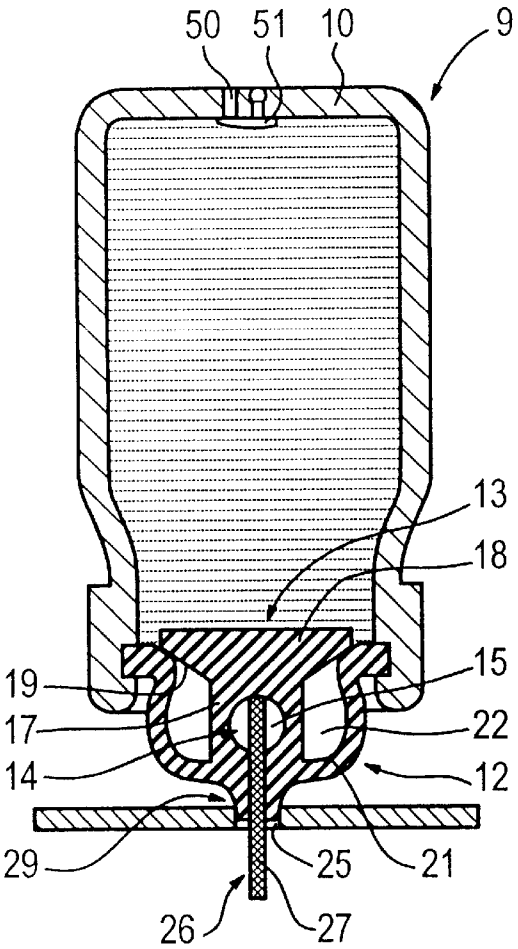
FIG. 3 is a sectional view of the application device of FIGS. 1 and 2 with a single-piece valve head illustrated in a closed position.

The cartridge 10 has its forward end closed by a valve head 12 which controls the release of the additive stored in the cartridge interior. The valve head 12 is constructed as a single-piece rubber part. The valve head 12 possesses a central valve passage body 13 in which a valve passage 14 is provided. The valve passage 14 has an afflux orifice 15 leading from a circumferential side of the valve passage body 13 into the interior of the valve passage body 13 where it communicates with an efflux orifice 16 which opens into an end of the valve passage body 13. The afflux orifice 15 and the efflux orifice 16 extend at right angles to each other. As FIG. 3 shows, the afflux orifice 15 is preferably configured as a radial through bore terminating on opposite circumferential sides of the valve passage body 13. The through bore design simplifies manufacture and effects speedy flooding of the valve passage 14. The valve passage body 13 has a cylindrical passage body 17 receiving the valve passage 14, and a conical valve section 18 which is essentially of a frusto-conical configuration. The conical valve section 18 is applied to the side of the passage body 17 facing away from the end of the valve passage body 13, tapering towards the passage body 17. Hence the valve passage body 13 is undercut as seen looking from the interior of the cartridge 10. The conical circumferential surface of the conical valve section 18 is provided as sealing surface 19 cooperating with a complementary, equally conical sealing surface 20 of an elastic shutoff element 21. The shutoff element 21 is integrally connected with the end of the passage body 17 lying close to end of the valve passage body 13, extending therefrom in a bell-shaped configuration towards the conical valve section 18. The shutoff element 21 is symmetrical about the axis, embracing the passage body 17 in cup shape or likewise essentially symmetrically about the axis. Provided on an inside of the free end of the shutoff element 21 is the conical or beveled sealing surface 20 which cooperates with the sealing surface 19 of the conical valve section 18. The shutoff element 21 is biased towards the conical valve section 18, causing the sealing surfaces 19 and 20 to be pressed against each other. The afflux orifice 15 of the valve passage 14 opens; into a cavity 22 bounded by the shutoff element 21 on the one side and by the circumferential surface of the valve passage body 13 on the other side.

Figure 5:
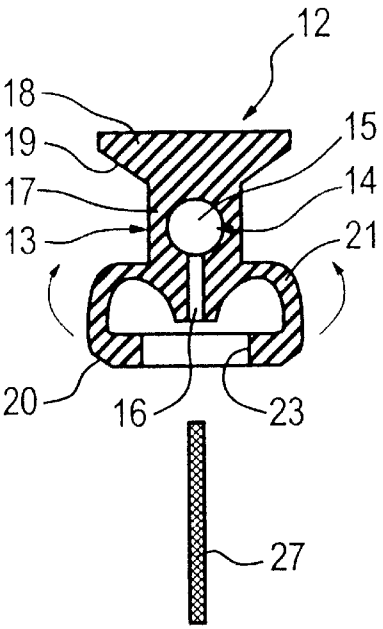
FIG. 5 is a sectional view of the valve head of FIGS. 3 and 4, illustrating a shutoff element in position in which it is not turned up.

The bell-shaped shutoff element 21 is of turnup construction, as shown in FIG. 5. For and after manufacture the shutoff element 21, rather than extending towards the conical valve section 18, extends from the end of the valve passage body 13 into which the efflux orifice 16 opens in opposite direction over and beyond the end. As a result, the undercut of the valve passage body 13, which later forms the cavity 22 and into which the afflux orifice 15 opens, is exposed and freely accessible. This simplifies manufacture significantly. To bring the valve head 12 into a configuration ready for operation, the shutoff element 21 is turned up or folded over in the direction of the conical valve section 18. Turning it up is a simple way of producing the bias of the shutoff element 21 against the conical valve section 18.

At the open end of the cartridge 10 the valve head 12 is seated onto the housing of the cartridge 10 and connected therewith. This connection is fluid-tight. As FIG. 3 shows, a cartridge seal 23 is provided at the free end of the shutoff element 21, which cooperates with a mating seal recess 24 on the circumferential inner surface of the cartridge 10. The cartridge seal 23 is formed integral with the shutoff element 21 and constructed as an essentially bead-shaped circumferential rib.

The maximum diameter of the valve passage body 13 is smaller than the inner diameter of the cartridge 10 in the area of the valve head 12, so that a circumferential annular clearance is produced between the valve passage body 13 and the housing of the cartridge 10. With the valve head 12 in the closed position according to FIG. 3, the passage between the valve passage body 13 and the housing of the cartridge 10 is closed by the shutoff element 21, in particular by the free end thereof. In this condition, the sealing surfaces 20 and 19 of the shutoff element 21 and, respectively, the conical valve section 18 cooperate with each other (cf. FIG. 3).

Figure 4:
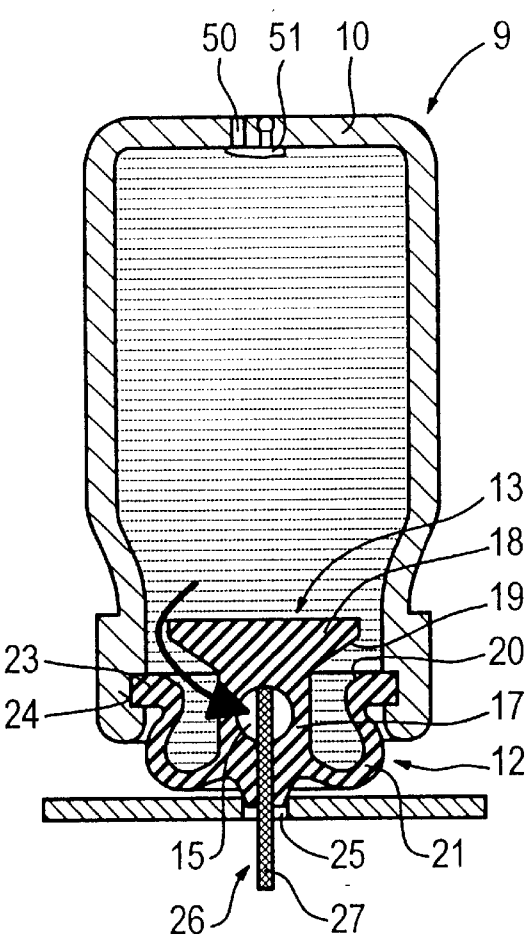
FIG. 4 is a sectional view similar to FIG. 3, showing the valve head in an open position.

To open the valve head, that is, to bring the afflux orifice 15 in fluid communication with the interior of the cartridge 10, it is necessary for the valve passage body 13 to be pushed into the interior of the cartridge 10, so that the free edge of the shutoff element 21 is unseated from the conical valve section 18, releasing the annular clearance between the valve passage body 13 and the housing of the cartridge 10 (cf. FIG. 4). Hence the shutoff element 21 is moved relative to the valve passage body 13 in an axial direction of the cartridge 10. As FIGS. 3 and 4 show, the valve head 12 is advantageously constructed to protrude beyond the end of the cartridge 10, so that opening of the valve head 12 only requires its end to be urged against an opposite end. It is thus only necessary for the end of the cartridge 10 to be urged against a stop. In the process, the shutoff element 21 snaps into an open position. To reclose the valve head 12, the cartridge 10 has to be pulled back, enabling the shutoff element 21 to snap back again. Conveniently, the end of the valve passage body 13 is fixedly connected with the opposite end, for example, by inserting it into an application opening 25 of the steam distribution chamber 7 under positive engagement therewith or by its threading engagement with the wall of the steam distribution chamber 7.

To dispense the additive from the cartridge 10 and release it into the steam path, the application device 9 possesses as capillary device 26 a capillary wick 27 which fits snugly within the efflux orifice 16 of the valve head 12. The capillary wick 27 extends through the efflux orifice 16 into the area of the afflux orifice 15 to become impregnated there with the additive stored inside the cartridge 10 when the valve head 12 is open. With its other end the capillary wick 27 protrudes from the valve head 12, extending through the application opening 25 into the steam distribution chamber 7 where steam flows around it. In this manner the capillary wick 27 sucks the additive through the valve head 12, releasing it through the circumferential surfaces at its protruding end to the passing steam.

Figure 10:
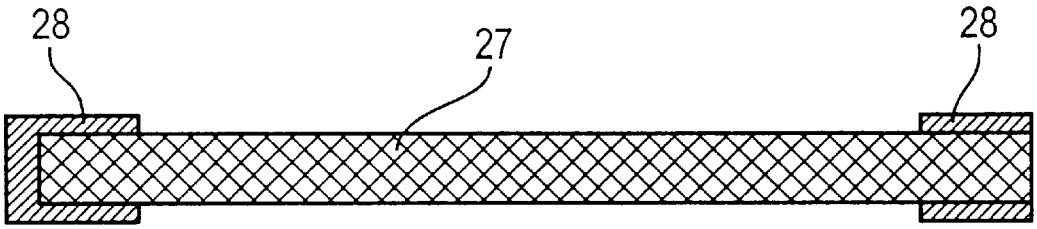
FIG. 10 is a schematic view of a capillary wick having a cap and a sleeve seated on the ends thereof.
Figure 11:
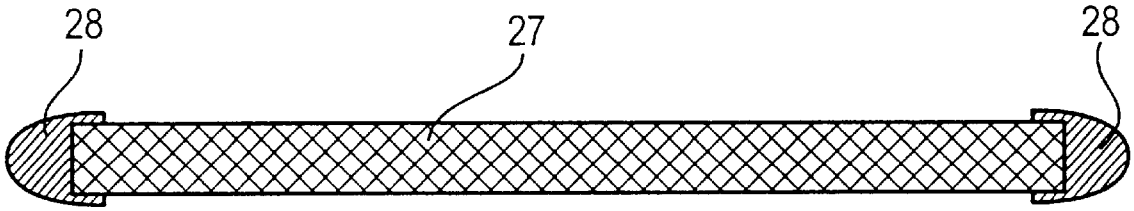
FIG. 11 is a schematic view of a capillary wick similar to FIG. 10, having rounded caps seated on the ends of the capillary wick.

The capillary wick 27 includes in principle a braided glass-filament hose into which a dimensionally stable, buckling-resistant support is inserted, lending the capillary wick 27 an overall dimensionally stable and pressure-resistant design. The support may be made of various materials, for example, of glass, metal, plastics or ceramics. The capillary effect takes place only in the braided glass-filament hose. Advantageously, the braided glass-filament hose affords ease of cleaning should it be soiled or clogged. In contrast to a tubular body as capillary, scale cannot build up in the steam path because the steam traveling past the capillary of fabric/glass-filament braiding automatically cleans the capillary, maintaining it hence in proper service condition. Alternatively, a ribbon- or rod-type capillary fabric/braiding is substituted for a braided glass-filament hose with support. To prevent the ends of the braided glass-filament hose from fanning, an end fixing device 28 is provided at either end of the capillary wick 27. Advantageously, an open sleeve or a cap having its one end closed may be used for this purpose, pushing and squeezing it onto the wick's end (cf. FIG. 10). The sleeve or cap may be made of aluminum or brass, for example. It is also possible to fit a spherical cap (cf. FIG. 11), particularly in cases where the support is made of glass it is possible for the glass-filament braiding to be fused with the glass support, whereby the spherically rounded caps at the ends are produced. For fixing the ends, they may also be immersed in a curing liquid as, for example, a synthetic resin.

Capillarity and velocity of flow of the additive in the to glass-filament hose may be adjusted by several parameters as, for example, by suitable selection of the fiber angle relative to the longitudinal axis, the type of yarn, the type of braiding, the thickness of the filaments, the wall thickness of the glass-filament hose and a treatment of the fibers. According to an advantageous embodiment of the invention, the fiber angle amounts to about 10 to 80 degrees relative to the longitudinal axis. The fiber thickness of the glass filaments is preferably between 5 and 50 $\mu$m.

As FIGS. 1 and 3 show, the application device is constructed as a separate and detachable replacement unit comprising the cartridge 10, the valve head 12 and the capillary device 26. To set the application device in operation, the cartridge 10, with the valve head 12 and the capillary device 26 leading, is inserted into the recess 11 of the iron's housing 1, in which process a steam path sealing section 29 at the forward end of the valve head 12 is inserted into the application opening 25, the valve head 12 thus sealingly closing the application opening 25 in the wall of the steam distribution chamber 7. Extending into the interior of the steam distribution chamber 7 is the capillary wick 27 protruding from the valve head 12 (cf. FIG. 2). To effect the release of the additive to the steam, the operator exerts thumb pressure to push the cartridge 10 farther into the interior of the iron's housing 1, causing the valve head 12 to open as described. This enables the capillary wick 27 to suck the additive from the cartridge 10 and release it to the passing steam. Advantageously, a locking device may be provided between the cartridge 10 and the iron's housing 1 to maintain the cartridge 10 in pushed-down position. To release only a limited amount of additive to the steam, it is also possible to press the cartridge down for a brief moment only, so that the cavity 22 fills with additive. After the shutoff element 21 snaps back into its shutoff position, the cavity 22 acts as a buffer reservoir. Only the quantity of additive stored therein is then allowed to reach the steam path through the wick. This enables an accurately metered charge of additive to be dispensed.

As an alternative to the monostable mode of operation of the valve device heretofore and subsequently described, in one variant added provision is made for a ball-point pen mechanism (not shown), a bayonet fitting or some other mechanism holding the application cartridge or the valve device bistably in an open or closed position. Operation is then similar to the conventional push-button operation of a ball-point pen, that is, upon pressure application the cartridge springs automatically into the valve-open or valve-closed position. It will be understood that for all embodiments described it is also possible to dispense with the cavity 22 as buffer reservoir so that switching over can be effected directly. In this event the valve device is correspondingly constructed. In a further variant the valve device itself is of bistable construction, meaning that it is maintained stable in two switching positions.

Figure 7:
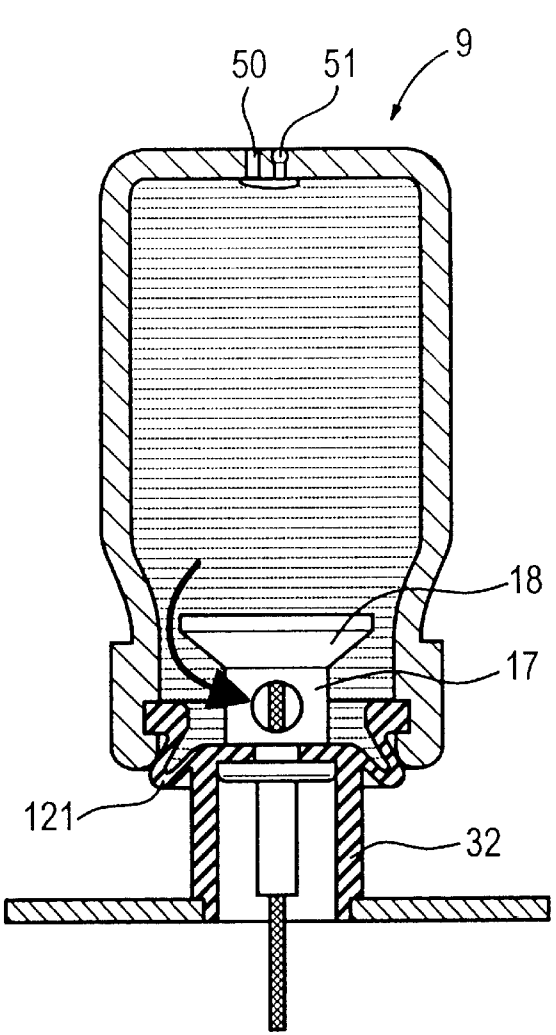
FIG. 7 is a sectional view similar to FIG. 6, illustrating the valve head in an open position.
Figure 6:
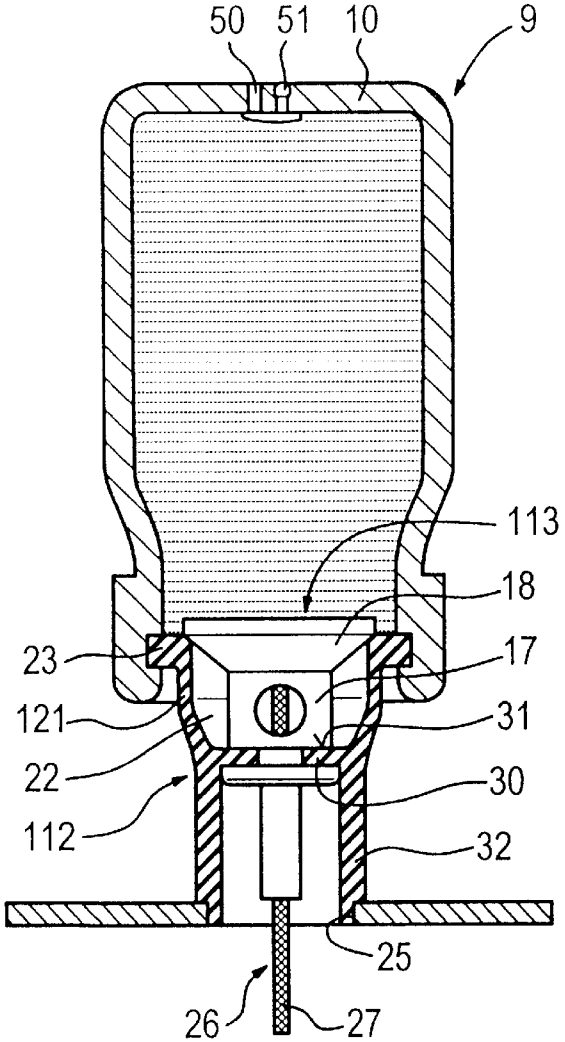
FIG. 6 is a sectional view, similar to FIG. 3, of an application device according to a further embodiment of the invention, in which the valve head is of a multi-piece construction and shown in a closed position.

A further embodiment of an application device of the present invention is illustrated in FIGS. 6 and 7. In this embodiment like parts have been assigned like reference numerals as in the FIGS. 3 and 4. The application device differs from the one previously described by a two-part construction of the valve head 112. The shutoff element 121 is constructed as a part separate from the valve passage body 113. The valve passage body 113 and the shutoff element 121 are sealingly connected with each other. To this effect, the shutoff element 121 includes an integrally formed sealing section 30 which is formed as a circular-ring-shaped rib received in fluid-tight engagement within a complementary sealing section 31 of the valve passage body 113. It will be appreciated that it is also possible to provide on the valve passage body 113 a rib-shaped circumferential and protruding sealing section which is received in a mating recess of the shutoff element 121. The shutoff element 121 is preferably made of rubber. The valve passage body 113 may be fabricated from various materials. As FIG. 6 shows, the shutoff element 121 has formed on it a cylindrical sealing neck 32 which projects towards the forward end of the valve head 112 to enable the valve head 112 to be inserted into the application opening 25 in the wall of the steam distribution chamber 7. The sealing neck 32 is of such rigid construction that when the cartridge 10 is pushed down it is not the sealing neck 32 but the shutoff element 121 that will buckle (cf. FIG. 7).

Figure 8:
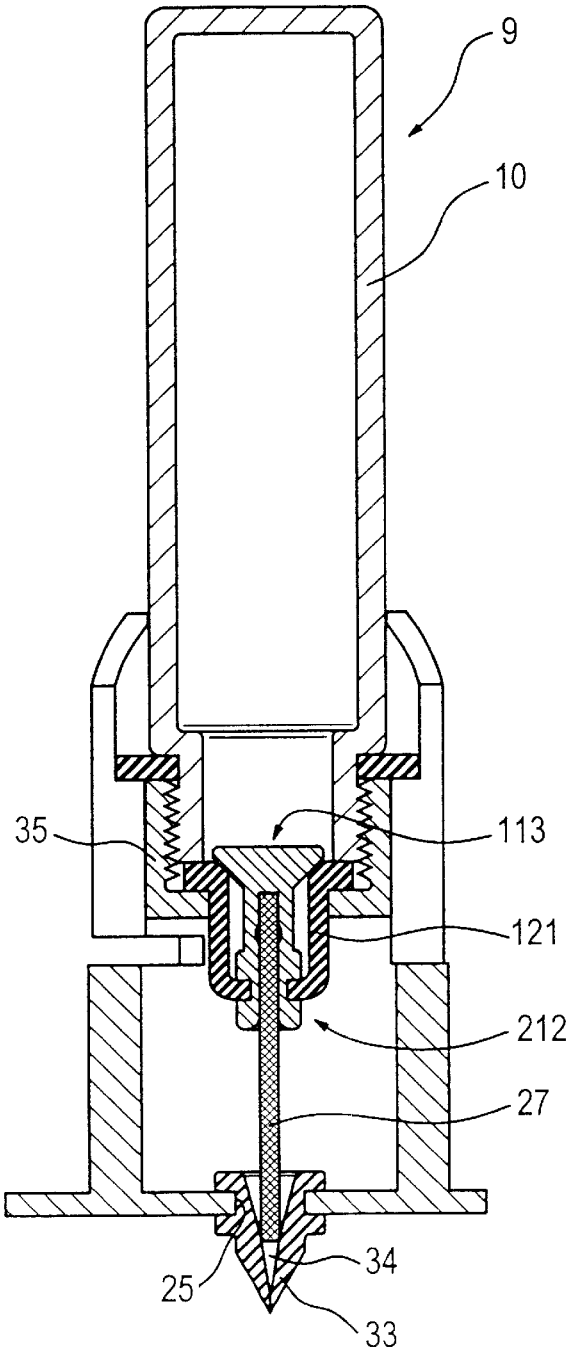
FIG. 8 is a sectional view of an application device according to a further embodiment of the invention, provision being made for a seal between the capillary device and the flow path of the steam.
Figure 9:
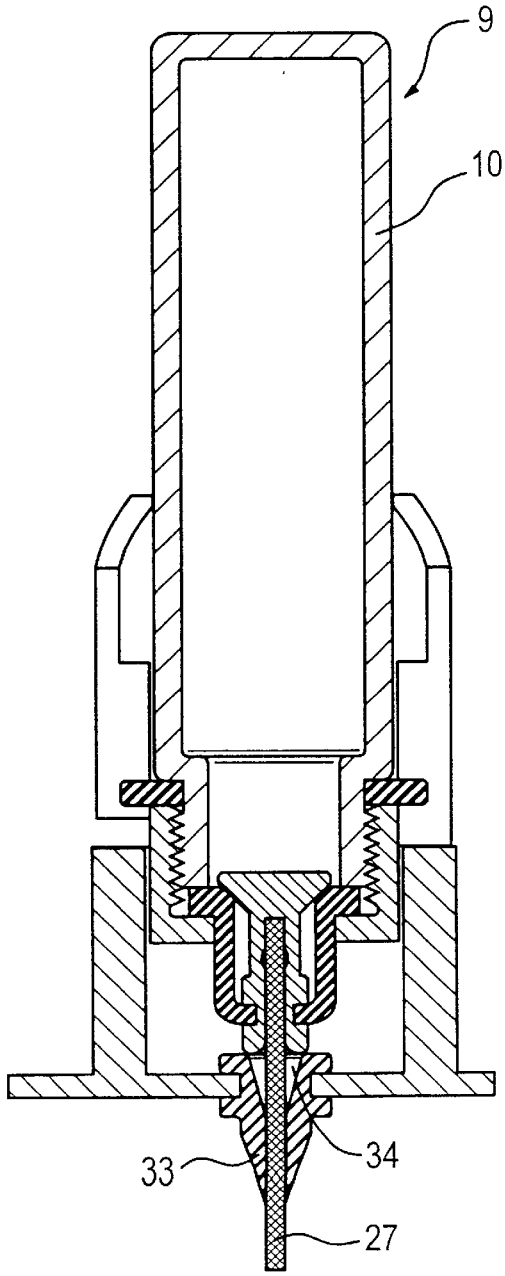
FIG. 9 is a sectional view similar to FIG. 8, showing the application device with the capillary device pushed through the seal.

Another embodiment of an application device of the present invention is illustrated in FIGS. 8 and 9 in which like reference numerals identify like elements as in the FIGS. 6 and 7. The application device differs from the one according to FIGS. 6 and 7 essentially by the provision of a steam path seal 33 separate from the valve head 212, which is inserted into the application opening 25 in the wall of the steam distribution chamber 7. The steam path seal 33 has a circumferential groove adapted to receive the wall of the application opening 25. This locates the steam path seal 33 axially and radially and closes the application opening 25 fluid tight. As FIG. 8 shows, the steam path seal 33 has a central wick opening 34 which overall is of a funnel-shaped configuration, widening in the direction of the valve head 212. With the steam path seal 33 in non-expanded condition, the wick opening 34 is closed, that is, the wick opening 34 is only opened when the wall of the steam path seal 33 bounding the wick opening 34 is elastically expanded. As FIG. 9 shows, the capillary wick 27 is pushed through the wick opening 34, expanding the opening in the process to enable the capillary wick 27 to be introduced into the steam distribution chamber 7. The provision of a separate steam path seal 33 has the advantage that the steam path is closed also when the application device 9 is removed, so that the steam is allowed to be discharged exclusively through the discharge ports provided for this purpose on the underside of the soleplate 4. This also avoids problems when it is desired to operate the iron without the application device 9.

As FIGS. 8 and 9 show, the shutoff element 121 of the valve head 212 is brought into sealing engagement with the housing of the cartridge 10 by means of a screw cap 35. This enables the valve head 212 to be readily removed from the cartridge 10 for replenishment of the cartridge.

It will be understood that also in the embodiment of FIGS. 8 and 9 provision is made for venting (not shown) the cartridge 10. In FIGS. 3, 4, 6 and 7 an air vent 50 is formed in the cartridge. A rubber-elastic, mushroom-shaped flap valve 51 opens the vent 50 in the presence of a pressure below atmospheric in the cartridge, keeping it otherwise closed. In one variant, the valve device is provided jointly with a cartridge or some other reservoir without vent. In this case it is possible, using an axial pumping motion of the shutoff element 21 or a similar resilient portion or by aspiration, that is, by producing a pressure below atmospheric at the efflux orifice 16, to pump or draw fluid from the reservoir or the cartridge 10.

The application device described and/or the valve may be used to advantage not only in pressing irons but generally in connection with steam irons. Furthermore, the application device, in particular the valve device, where applicable in connection with the associated cartridge, may also be used to advantage in other appliances for personal use, including, for examples, hair application apparatus or oral hygiene apparatus, oral irrigators (with check valve function), coffee makers or apparatus for shaving care. Particularly when used with detachable tanks or liquid reservoirs, the valve device is usable to advantage. It is then not necessary for a capillary wick to be in communication with the valve device. Owing to the onepiece rubber valve construction the need for several seals and springs is obviated.

As FIGS. 12 to 15 show, the application device may also be coupled with a spraying device enabling the additive to be sprayed onto the laundry to be ironed directly through a spray nozzle 36. As additive storage reservoir 37 a tank separate from the water tank may be provided. Preferably, a detachable storage cartridge of the type described in the foregoing may also be used.

Figure 12:
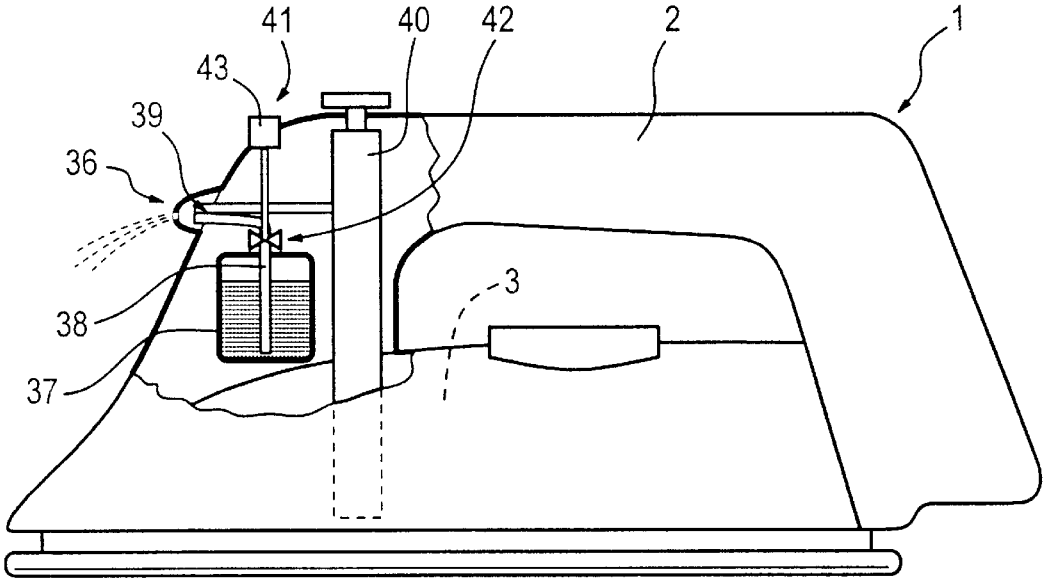
FIG. 12 is a schematic side view, partly sectioned, of a pressing iron, in which the application device is connected, via a valve and a venturi nozzle, with a spraying device for spraying the laundry to be ironed.
Figure 13:
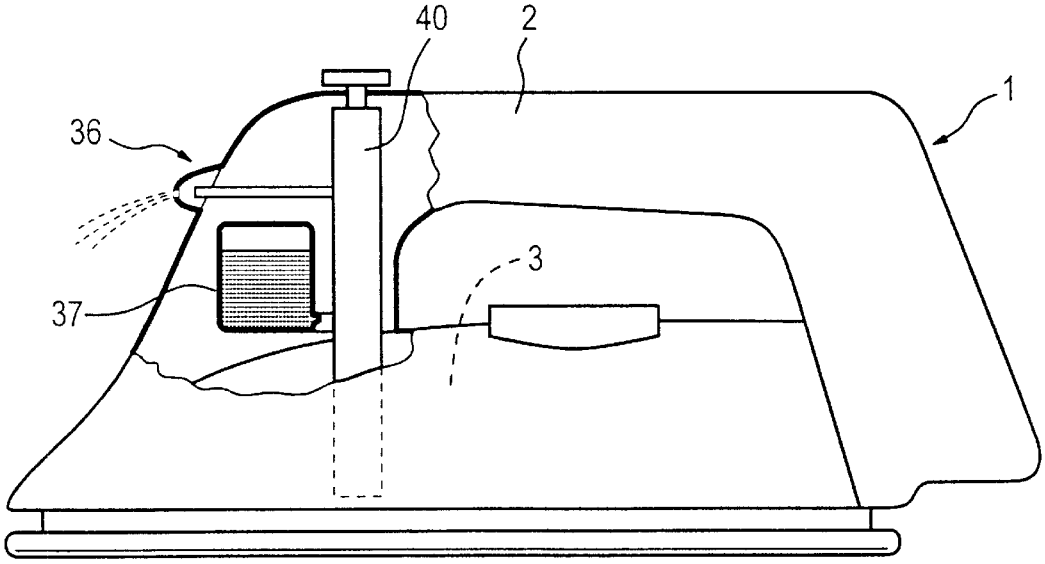
FIG. 13 is a schematic view of a pressing iron similar to FIG. 12, in which the application device is connected to a switchable pump for spraying water and additives.
Figure 14:
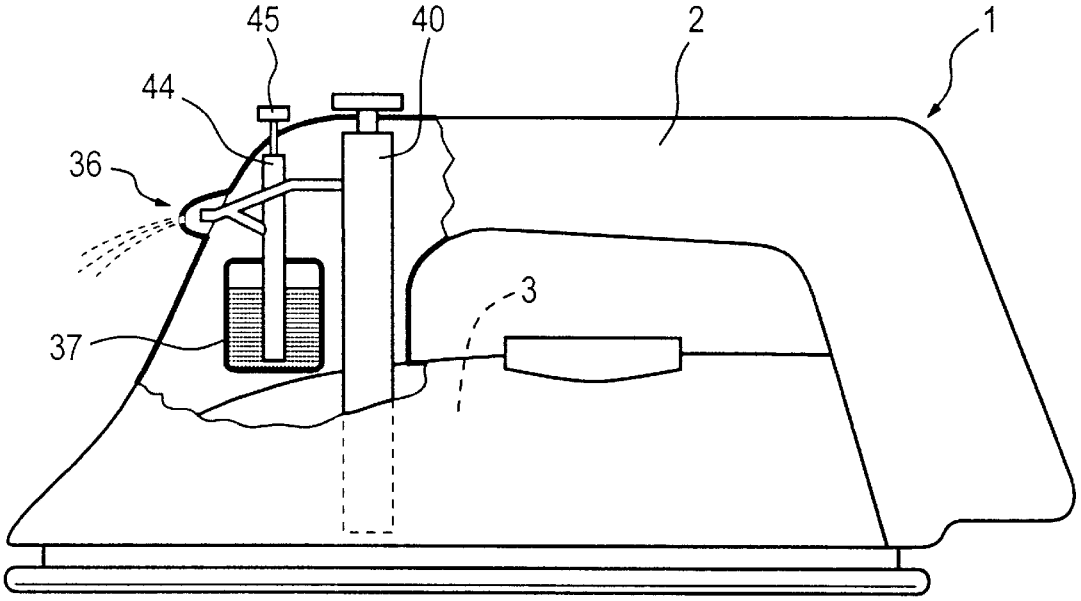
FIG. 14 is a schematic view of a pressing iron similar to FIGS. 12 and 13, in which the application device is connected to a separate pump for discharging the additive in spray form.
Figure 15:
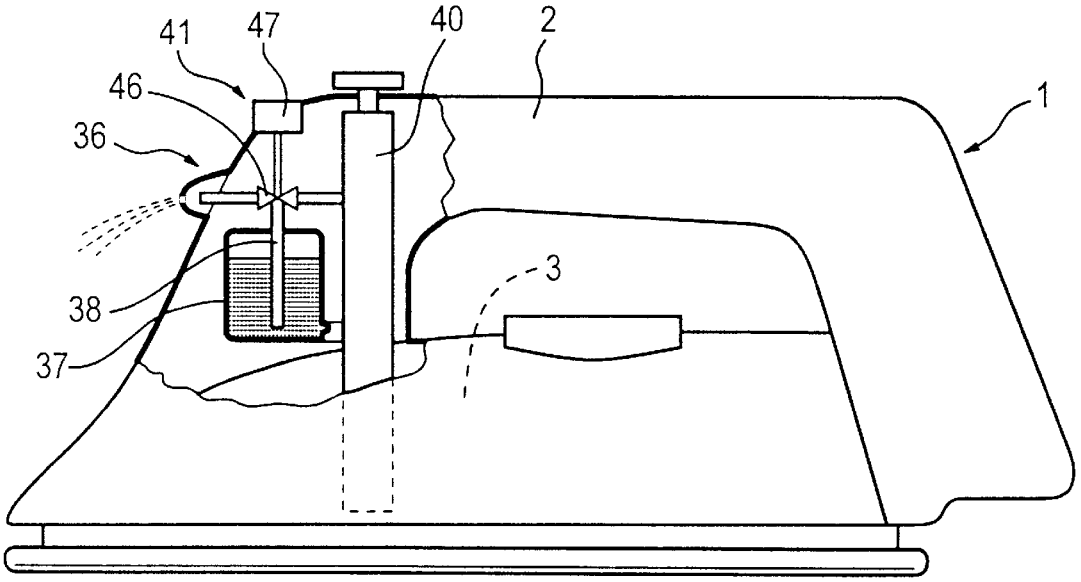
FIG. 15 is a schematic view of a pressing iron similar to FIGS. 12 to 14, in which the application device is connectable to the pressure side of a spray pump via a valve, thus enabling water and/or an additive to be discharged in spray form.

Advantageously, an additive duct 38 which is in fluid communication with the additive storage reservoir 37 may be coupled through a venturi nozzle 39 to the water spraying device or duct customarily provided in pressing irons (cf. FIG. 12). The spraying device includes a pump 40 drawing water from the tank portion 3 and discharging it in spray form through the spray nozzle 36. Through the venturi nozzle 39 additive is aspirated from the additive storage reservoir 37 and discharged in spray form together with the water. Provision is made preferably made for a metering device 41 for metering the amount of additive to be sprayed. The metering device 41 controls the ratio of sprayed water to sprayed additive which in principle may be set at between 0 and 100%. The metering device 41 includes an additive valve 42 which is inserted in the additive duct 38. As FIG. 12 shows, the additive valve 42 is adjustable by means of a control device 43 which is arranged on the upper side of the gripping portion 2 for actuation. It is thereby possible to control the ratio of sprayed water to sprayed additive. It is of particular advantage in this connection that the spray nozzle 36 discharges both water and additive, thus avoiding clogging or drying out of the nozzle due to the application of additive.

According to another embodiment (FIG. 13) the application device may also be connected with a suction side of the spray pump 40, instead of with its pressure side. In this embodiment the additive, rather than being aspirated and sprayed through a venturi nozzle, is aspirated directly on the suction side of the pump. Conveniently, the pump 40 is of the switchable type, so that it is able to aspirate water from the tank portion 3 and the additive from the additive storage reservoir 37 alternately and discharge it through the spray nozzle 35. Preferably the pump is switchable between three positions, including a first one in which only water is sprayed, a second one in which only the additive is sprayed, and a third position in which a mixture of water and additive is sprayed. Here too, the spraying of water through the spray nozzle 36 prevents the nozzle from clogging or drying out. Serving as metering device in this embodiment is the pump 40 direct.

According to still another embodiment (FIG. 14), provision may be made for a separate additive pump 44 for spraying the additive, which pump may be set in operation by means of a control device 45 arranged on the forward upper side of the gripping portion 2. Metered application of the additive takes place directly by the additive pump 44. The pressure lines of the two pumps 40 and 44 terminate jointly in the spray nozzle 36 so that both the water from the tank portion 3 and the additive from the additive storage reservoir 37 are discharged in spray form through this nozzle.

According to yet another embodiment (FIG. 15), the additive storage reservoir 37 of the application device may be connected with the pressure line of the spray pump 40 through an adjustable valve 46. The valve 46 may be constructed as an On/Off valve, so that a selection can be made between the supply of water and the supply of additive. Preferably, the valve 46 is constructed as an infinitely variable valve, so that the quantitative ratio of water to be sprayed to additive to be sprayed can be adjusted. To this effect on the upper side of the gripping portion 2 provision is made for a control device 47 connected with the valve 46.

The coupling of the application device to the spraying device of a pressing iron described with reference to FIGS. 12 to 15 may be provided as an addition to the aforedescribed release of the additive to the steam discharge.

Further variants relating to the valve device and their possibilities of use will be described in the following.

Figure 16:
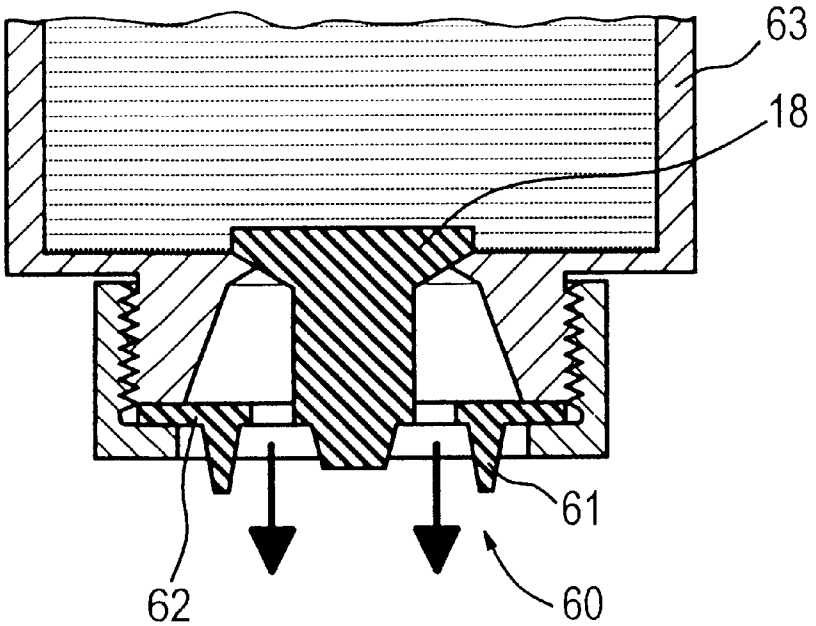
FIG. 16 is a sectional view of a valve device having a conical valve section and a disk-shaped shutoff element secured to the fluid reservoir.

In one variant the conical valve section is provided with a thin-walled servo sealing surface. For this purpose a conical recess may be provided, for example, in the upper end surface of the valve section, thus producing a thin-walled section. In a further variant of the valve device, the passage body 17 and the conical valve section may be fabricated from a harder material than that of the resilient shutoff element 21 and the adjoining sealing surface 20. Hence only that area of the valve device is of an elastic-soft construction which, by virtue of its insertion as a seal or its resilient, elastic or rebounding action, requires these material properties. The two different material properties are achievable, for example, in the form of a single-piece valve device fabricated by a hard-soft plastic injection-molding technique using, for example, materials of two different Shore hardness values. According to a further variant, the valve section is not of a conical but of a disk-shaped configuration. In another variant, there is no central passage with a passage body, but rather, efflux orifices are formed between the then massive passage body and the shutoff element. This solution is appropriate in the absence of a capillary wick to be inserted into the valve device, that is, in cases where the valve device is required to exert the valve function or check valve function in other apparatus. Particularly in combination with such an embodiment a tappet may be arranged opposite the massive passage body, said tappet being operable to move the valve device into an open and closed position. According to a still further variant, the elastic section of the shutoff element which is responsible for the axial movability is of a disk-shaped configuration. Such a valve device 60 is illustrated in FIG. 16. Here the valve device closes a fluid tank and is secured to the tank by a threaded cap, effecting a press-fit seal. The shutoff element 62 has not shutoff function, but rather serves to ensure the elastic, axial movability of the conical valve section 18 which sealingly cooperates with a mating surface on the reservoir 63, rather than with the shutoff element. Provided on the shutoff element 62 are downwardly projecting noses 61 acting as seal or support relative to the surface of an opposite part.

Figure 17:
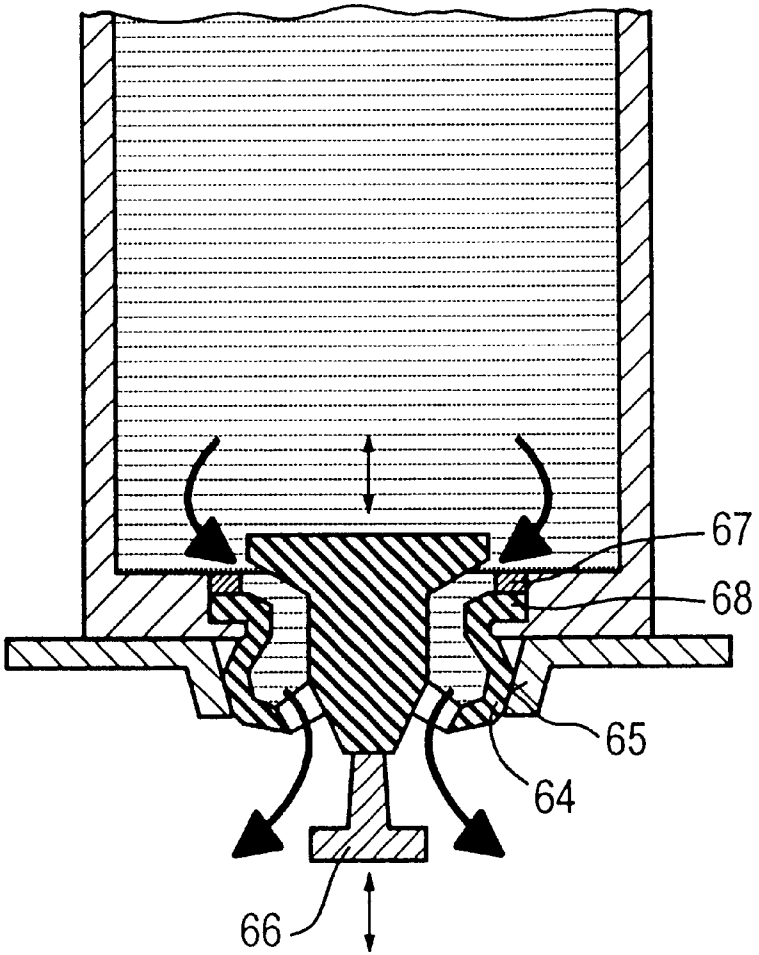
FIG. 17 is a sectional view, similar to the one of FIG. 16, of a valve device with a tappet for opening the valve.
Figure 18:
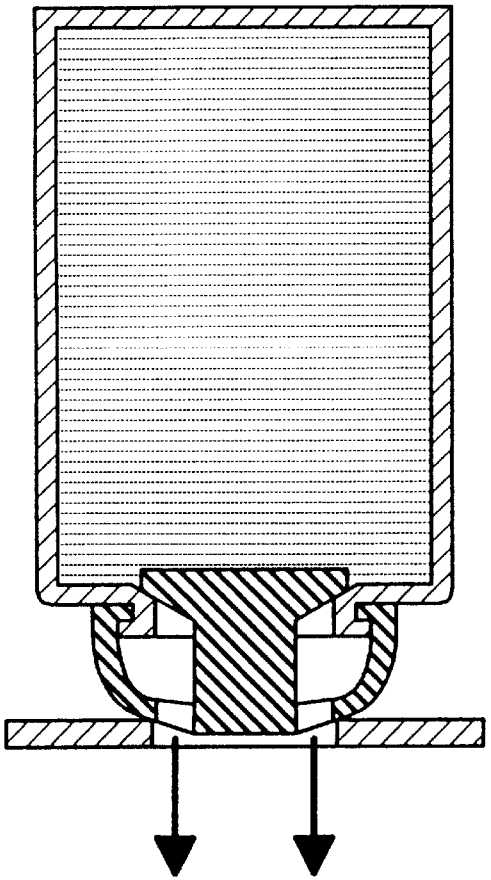
FIG. 18 is a sectional view of a valve device secured to the outside of a fluid reservoir.

FIG. 17 illustrates an application of the valve device in which the outer surfaces 64 of the shutoff element sealingly cooperate with complementary sealing surfaces 65 of the opposite part. A tappet 66 pushes the valve device into the open position. The ends 68 of the shutoff element may not only be secured in sealing fashion by engaging the inside of the reservoir or cartridge as by means of a clamping ring 67 as in this and the previously described embodiments, but may be suitably turned over to be secured in sealing fashion by engagement with the outside of the reservoir. A corresponding alternative embodiment is illustrated in FIG. 18.

FIGS. 19*a* and 19*b* show a valve device which is inserted in a tube provided with a clamping ring. This valve device opens automatically as soon as a fluid current acts inwardly against the conical valve section. By contrast, in the reverse direction of fluid flow the valve device inhibits flow automatically because the fluid pressure urges the conical valve section against the sealing surface on the shutoff element. The valve device hence represents a check valve incorporating in itself all sealing connections with the tube, resilient sections, and opening and closing sections.

FIG. 20 shows a valve device in a coffee maker which does not release the flow of coffee to the carafe until a carafe is moved underneath past a slide cap 70 on the valve device. The valve device is mounted underneath the coffee filter holder 72. The carafe lid 73 has an elevation 71 for cooperation with the slide cap 70.

FIG. 21 shows an application of the valve device as a leak-proof suction valve on a nursing bottle. Advantageously, the function of the valve device is similar to that of a mammilla, because simultaneous pressing and sucking on the discharge orifice causes the fluid path to be opened, and the valve device, following use, automatically snaps back into the closed position due to its resiliency. For this application the valve device operates preferably monostably, with the stable condition being the closed position. By suitably modifying the valve device (as by making movement of the resilient shutoff element more sluggish), only such quantity as is predetermined in the cavity 22 is made available so that the risk for the baby to swallow the wrong way is reduced. It will be understood that this valve device is also suitable for use in other drinking bottles, for example, on bicycles or in the trekking field.

It will be appreciated, of course, that the valve device is also suitable for use in all personal products having a detachable fluid tank, the valve device operating in such manner that the tank is open only when actually used in the apparatus (for example, water purifier, oral irrigator, pressing iron, coffee maker, air humidifier, shaver), being closed automatically when the tank is detached for replenishment. The valve device may be utilized in reservoirs from which a predetermined metered amount is to be discharged, as in the fields of hair cosmetics, dispensers of any kind, containers for medicine, liquid writing instruments, metering syringes, body care, tooth cleaning products, sunscreens, because a constant quantity is invariably pre-proportioned in the cavity 22. The valve device may also be used to advantage with pressurized bottles filled with propellant. Utilizing the monostable or bistable conditions, the valve device may also find application in liquid-proof electric switches.

What is claimed is:

1. A steam iron with a steam generating device for the generation of steam comprising an application device for releasing an additive to the steam, the application device comprising a capillary device for release of the additive to the steam.

2. The steam iron as claimed in claim 1, wherein the capillary device is arranged at a location downstream from the steam generating device.

3. The steam iron as claimed in claim 1 wherein the capillary device is movable into and removable from a steam flow path.

4. The steam iron as claimed in claim 1, wherein the capillary device includes a capillary wick.

5. The steam iron as claimed in claim 1, wherein the capillary device includes a capillary fabric and a support carrying said capillary fabric.

6. The steam iron as claimed in claim 1, wherein the capillary device includes a braiding of glass filaments.

7. The steam iron as claimed in claim 1, wherein the application device includes a valve device interposed between the capillary device and an additive storage reservoir.

8. The steam iron as claimed in claim 7, wherein the valve device is constructed as a single-piece component.

9. The steam iron as claimed in claim 7 wherein the valve device includes a central valve passage body and a shutoff element extending from the valve passage body in the shape of a cellar, said shutoff element being adapted to be turned up into an operating position.

10. The steam iron as claimed in claim 9, wherein the shutoff element is adapted to snap back and forward between a closed position and an open position.

11. The steam iron as claimed in claim 7, wherein the valve device includes a buffer reservoir which is disconnected from the additive storage reservoir with the valve device in a closed condition.

12. The steam iron as claimed in claim 9, wherein the valve passage body and the shutoff element have a respective conical sealing surface adapted to be brought into relative engagement.

13. The steam iron as claimed in in claim 7, wherein the valve device includes a mount for receiving the capillary device.

14. The steam iron as claimed in claim 7, wherein the valve device has a reservoir seal to effect a seal on the additive storage reservoir.

15. The steam iron as claimed in claim 7, wherein the valve device is constructed as the valve head of a storage cartridge, said valve head, by pushing it into a cartridge interior, being movable into an open position.

16. The steam iron as claimed in claim 7, wherein the valve device is constructed as an integral rubber part.

17. The steam iron as claimed in claim 1, wherein the application device is configured as a separate, prior assembled replacement unit.

18. The steam iron as claimed in claim 1, wherein the application device includes a storage cartridge having an interior, and further comprising a valve head arranged on the storage cartridge for controlling a connection between the cartridge interior and the capillary device.

19. The steam iron as claimed in claim 1, wherein the application device is movable into and lockable in various positions, such that the release of additive by the capillary device is activatable and deactivatable.

20. The steam iron as claimed in claim 19, wherein the storage cartridge is displaceable and lockable in position, so that the valve head opens and closes.

21. The steam iron as claimed in claim 18, wherein the storage cartridge is displaceable and lockable in position, so that the valve head opens and closes.

22. The steam iron as claimed in claim 1, wherein the application device is insertable into a recess in the steam iron accessible from the outside and terminating in a gripping area.

23. The steam iron as claimed in claim 1, wherein the application device is adapted to be brought into fluid communication with a spraying device for spraying the objects to be treated.

24. The steam iron as claimed in claim 1, wherein the capillary device is arranged in a steam distribution chamber.

25. A consumer product comprising a steam generating device for the generation of steam and an application device for releasing an additive to the steam and a capillary device for release of the additive to the steam.

26. A removable application device for releasing an additive to steam having a capillary device for release of the additive to the steam.

27. A valve device for use with a fluid reservoir, the valve device comprising elastic sections formed integral thereon and a sealing surface, said valve device being movable into an open and closed position by the elastic sections, the integrally formed elastic sections being securable to the fluid reservoir in sealing fashion.

28. The valve device as claimed in claim 27, further comprising an efflux orifice, wherein when the valve device is attached to the fluid reservoir, a cavity which holds a predetermined fluid quantity is formed between the sealing surface and an efflux orifice.

29. The valve device as claimed in claim 27 wherein the valve section snaps into one of monostable and bistable conditions.

* * * * *